US012320622B2

(12) United States Patent
Wysoczanski

(10) Patent No.: US 12,320,622 B2
(45) Date of Patent: Jun. 3, 2025

(54) TARGET SHOOTING TRAINING DEVICE MARKER

(71) Applicant: Krzysztof Wysoczanski, San Diego, CA (US)

(72) Inventor: Krzysztof Wysoczanski, San Diego, CA (US)

( * ) Notice: Subject to any disclaimer, the term of this patent is extended or adjusted under 35 U.S.C. 154(b) by 1009 days.

(21) Appl. No.: 17/363,996

(22) Filed: Jun. 30, 2021

(65) Prior Publication Data

US 2021/0404775 A1 Dec. 30, 2021

Related U.S. Application Data

(63) Continuation-in-part of application No. 16/493,392, filed as application No. PCT/US2018/022066 on Mar. 12, 2018, now abandoned.

(60) Provisional application No. 62/470,956, filed on Mar. 14, 2017.

(51) Int. Cl.
*F41J 5/24* (2006.01)

(52) U.S. Cl.
CPC ..... *F41J 5/24* (2013.01)

(58) Field of Classification Search
CPC ..... F41J 5/24; F41J 1/01
See application file for complete search history.

(56) References Cited

U.S. PATENT DOCUMENTS

| | | | | | |
|---|---|---|---|---|---|
| 1,369,830 | A * | 3/1921 | Mitchell | F41J 9/165 | 273/363 |
| 3,370,852 | A * | 2/1968 | Kandel | F41J 1/01 | 273/378 |
| 4,243,228 | A * | 1/1981 | Marcella | F41J 1/00 | 273/365 |
| 4,773,653 | A * | 9/1988 | Unverzagt | F41J 13/00 | 273/408 |
| 2009/0008878 | A1* | 1/2009 | Jones | F41J 3/0019 | 273/404 |
| 2013/0193646 | A1* | 8/2013 | Su | F41J 1/01 | 273/407 |
| 2013/0193648 | A1 | 8/2013 | Su | | |
| 2013/0270773 | A1* | 10/2013 | Johnson | F41J 5/24 | 273/408 |
| 2016/0327377 | A1* | 11/2016 | Flynn | F41J 1/00 | |

* cited by examiner

*Primary Examiner* — Jeffrey S Vanderveen
(74) *Attorney, Agent, or Firm* — David B. Waller

(57) ABSTRACT

The invention is a training device marker for target shooting. The device contains a semi-rigid support having a forward side, a back side and a flexible material cover stretched over the forward side of the semi-rigid support. The forward side has a first marking and the back side has an affixing means for attaching the semi-rigid support to an existing target. The flexible material cover has a second marking such that when the flexible material is penetrated by a projectile, the flexible material tears away from the semi-rigid support exposing the first marking. The partial or complete removal of the flexible material cover alerts the shooter that the marker has been hit. This has the advantage of being able to be observed at a distance, and with multiple training device markers affixed on a target, the user does not have to stop and confirm a hit after each shot.

8 Claims, 1 Drawing Sheet

TARGET SHOOTING TRAINING DEVICE MARKER

CROSS-REFERENCE TO RELATED APPLICATIONS

This application is a continuation-in-part of patent application Ser. No.; 16/493,392 filed 19 Oct. 2019, which claims benefit of priority to PCT patent application serial no. PCT/US2018/022066 filed Mar. 12, 2018 under 35 USC § 120 and U.S. provisional patent application Ser. No. 62/470,956 filed Mar. 14, 2017 under 35 U.S.C. § 119(e), which are incorporated by reference herein in their entirety.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates generally to devices that can be affixed to existing targets that assist in training an individual on how to aim a weapon when firing a projectile or become more proficient and accurate in placing a projectile in a desired location when using a weapon. More specifically, the invention is not a target, it is a device that may be affixed to an existing target and allows the user to identify when that particular location of the target has been hit by providing a visual signal that can be observed at a distance without the assistance of a visual aid. In addition, since multiple markers can be placed on an existing target, the user can continue shooting without having to confirm a hit after each shot. It also allows the user to select a desired target that has a particular image of interest for use with the present invention.

BACKGROUND OF THE INVENTION

When learning how to aim and shoot projectile weapons, such as a gun, which includes guns that utilize gun powder or compressed air to launch a projectile or a bow which includes long bows, compound bows, crossbows and the like, an individual often visits a target range, places a paper target at a desired distance and shoots at the target. When a certain number of shots have been fired, the individual views the target by retrieving it with the use of a hand operated or mechanically operated pulley like a clothes line. Alternatively, the individual may have binoculars or a spotting scope to see the target or utilize a spotter who can provide information after each shot. With the exception of using a spotter, which requires a second individual to be present with a visual aid during shooting, an individual can only determine their accuracy after firing several shots, evaluating the target and then shooting another series of rounds repeating the process. It would be preferable if the individual could aim the weapon, shoot and then know instantly whether the target was hit in the desired location without removing their eye from the sight. This would allow the individual to maintain their line of fire for the next series of shots. If this were the case, training times could be decreased, the amount of projectiles fired would be less and the amount of additional equipment and cost associated therewith could be reduced. Consequently, the overall cost of training individuals such as Policemen and Military personnel could be significantly reduced.

There are a number of targets that when contacted with a projectile, explode providing a clear indication that the target was hit. However, while this type of target provides an immediate indication of success, they are also costly to produce and consequently purchase, they increase the amount of noise associated with discharging a weapon, they discharge sparks that could, in dry area like California, have the potential of starting a fire and could be misinterpreted as an attack.

U.S. patent application Ser. No. 13/359,768 to Su teaches an affixable firearms target capable of leaving a custom-shaped silhouette visible by the user from a distance when a projectile impacts the target's bullseye. The device comprises a main layer with adhesive on the back side in contact with a target pattern wadding layer, an interior portion containing a perforated pattern matching the wadding layer pattern and a bullseye bullet resistant layer mounted on top of the target pattern wadding layer on the front side. When the bullseye bullet resistant layer is impacted by a projectile it pushes the wadding layer into the perforated pattern of the interior portion tearing the target pattern from the device leaving a pattern that can be visualized by the user at a distance. However, this device comprises four elements of which the target pattern wadding layer is expended after being impacted by a projectile and the bullseye layer would be lost or difficult to find following impact. Consequently, it would be difficult to reuse this device. Further, the ability to visualize the silhouette shape following impact will rely on the background of the shooting range target area. Thus, if light colored gravel is behind the targets, then a target of the invention with a dark colored main layer should be used. Conversely, if dark colored trees are behind the targets, then a target of the invention with a light colored main layer should be used. This requires that the user have multiple targets in multiple colors for different shooting range environments. Further, this device requires that the user hit the bullseye layer to produce the desired custom silhouette to appear. Any hit that does not hit the bullseye layer squarely could damage the target so that the custom silhouette cannot occur even if the second projectile squarely contacts the bullseye layer.

The device of Su is complicated having four layers, requiring that the user squarely impact the bullseye with a projectile to produce the desired custom silhouette and all other attempts being clear of the target to prevent damaging it prior to the bullseye impact. The device's elements could potentially be replaced after impact for reused a second or third time, however, the multilayer design makes this difficult at best.

U.S. Pat. No. 3,370,852 to Kendal is a self-enlarging-puncture firearm target. The firearm target contains a backing sheet of target material and a sheath of elastic material having a target design marked on its surface, composed of uniformly spaced, concentric, circular lines, and stretched over the backing sheet. To provide a target that can be impacted several times without the elastic material completely retracting from the target's face after the first projectile impact, the elastic layer is designed to retract selectively exposing a larger aperture than that created by the projectile but preventing the flexible layer from tearing completely away from the backing sheet. Consequently, when the bullet strikes the target, it penetrates in succession the front or target side of the sheath, base sheet and the back side of the sheath forming openings. Thereupon the stretched sheath immediately will retract selectively in the area of the bullet puncture, enlarging the opening. The extent of the enlargement of the sheath in the area of the puncture will be limited by integral ribs thereby preventing involvement of an excessively large portion of the sheath area. To make the enlarged opening created by this unique configuration of the elastic material more visible, the surface of the base sheet and outer or target surface of the sheath, contrast sharply in color. For example, the face surface of the base sheet may be brilliant fluorescent red, while the outer surface of the sheet may be white.

The device of Kendal is designed to be a single target that is able to withstand several projectile impacts, exposing enlarged impact apertures visible at a distance by the contrasting colors of the outer surface of the elastic material sheath with the face surface color of the base sheet, and preventing the elastic material from fully rupturing and tearing away from the base sheet by unique integrated and integral ribbing on one side of the elastic material sheath. Because the Kendal device is a complete firearm target that can withstand several projectile impacts it is not a marker per se. A marker is designed to be used with an existing target allowing the user to select a target of choice and then apply the markers on that target to specific areas desired. For example, if the user's target of interest contains an image of a buffalo, then the target markers could be placed over areas of the buffalo to practice specific shots such as over the heart or head. For the Kendal device to operate similarly, it would have to be produced with an image of a buffalo on the face surface of the elastic material sheath. This poses a problem considering that each user may prefer a particular image meaning the Kendal device would have to be prepared with hundreds of selected images at great cost. Another target could not be placed over the Kendal target because the applied target would cover the selectively enlarged area around the bullet puncture preventing visualization at a distance, thereby frustrating the unique design of the Kendal invention. The Kendal target may be used to visualize projectile impacts on its surface at a distance but only markers can be utilized with a variety of targets including the Kendal target to achieve the same enhanced visualization.

As such, there is a continuing unmet need for a device for use by amateurs and marksmen alike that will provide an immediate indication of whether the desired location on the target has been hit, reduce the cost of equipment and supplies required for target training and reduce the time required for training to reach a desired proficiency.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The present invention is a target shooting training device marker to be affixed to an existing projectile impact target. The device contains a semi-rigid support having a forward side and a back side and a flexible material cover stretched over the forward side of the semi-rigid support. The forward side is of a color or pattern that is indistinguishable from the existing projectile impact target to which it is affixed and the back side has an affixing means thereon for attaching one or more target shooting training device markers to an existing projectile impact target. The replaceable flexible material cover is of a thickness able to be stretched over the semi-rigid support and of a color that is easily observed by the user at a distance from the existing projectile impact target containing the one or more target shooting training device markers. When the flexible material cover is penetrated by a projectile, the flexible material cover tears away from the semi-rigid support exposing the forward side of the target shooting training device marker having the same color or pattern of the existing projectile impact target causing the target shooting training device marker to essentially be indistinguishable from the surface of the existing projectile impact target when viewed at a distance. The replaceable cover is spherical in shape with a circular opening with a rim that is thicker than the replaceable flexible cover and able to be easily stretched over a new or used semi-rigid support. The affixing means may be an adhesive or tape and may have a protective cover to prevent damage prior to use. The affixing means may also be Velcro™.

In one embodiment, the semi-rigid support is made of a soft material that allows passage of a high speed projectile without significant deformation of the semi-rigid support. This semi-rigid support can be made of material such as a polymer or cardboard.

In another embodiment, the flexible material that covers the semi-rigid support is latex.

A target shooting training device marker may be round or oval. If it is round, then it may have a diameter of from about 2.0 inches, 2.5 inches, 3.0 inches, 3.5 inches, 4.0 inches, 4.5 inches, 5.0 inches, 5.5 inches, 6.0 inches or 6.5 inches. If it is oval, then the largest dimension may be from about 2.0 inches, 2.5 inches, 3.0 inches, 3.5 inches, 4.0 inches, 4.5 inches, 5.0 inches, 5.5 inches, 6.0 inches or 6.5 inches.

Another aspect of the invention is a method of training an individual to shoot a weapon. This method comprises the steps of affixing one or more of the target shooting training device markers described above to an existing projectile impact target at locations of interest and having the individual shoot at the target shooting training device markers on the existing projectile impact target. When the flexible material cover is penetrated by a projectile, it tears away from the semi-rigid support exposing the forward side of the target shooting training device marker having the same color or pattern as that of the existing projectile impact target surface causing the target shooting training device marker to essentially disappear (or be indistinguishable from the existing projectile impact target) when viewed at a distance.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

The objects, features, and advantages of the invention will be brought out in the following part of the specification, wherein detailed description is for the purpose of fully disclosing the invention without placing limitations thereon.

DETAILED DESCRIPTION OF THE INVENTION

Figure 1:
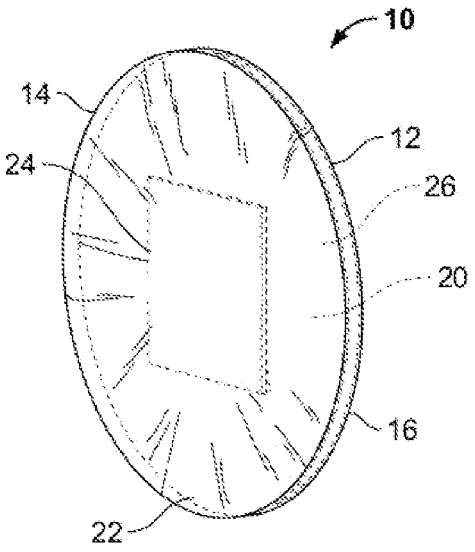
FIG. 1 shows a perspective view of one embodiment of the present invention.
Figure 2:
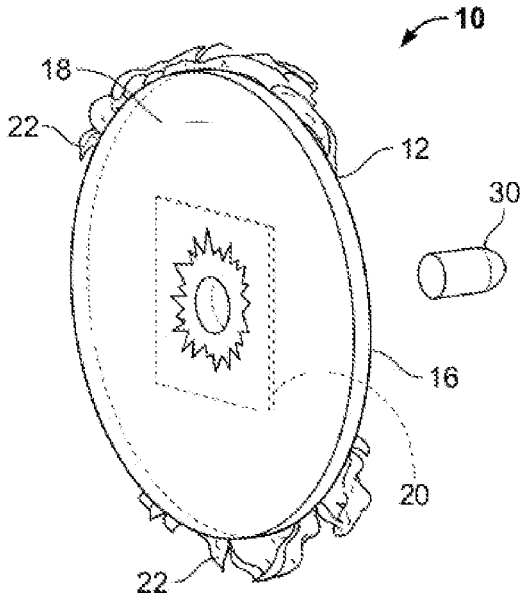
FIG. 2 shows the perspective view of FIG. 1 after impact with a projectile. In this figure the projectile is a bullet.
Figure 3:
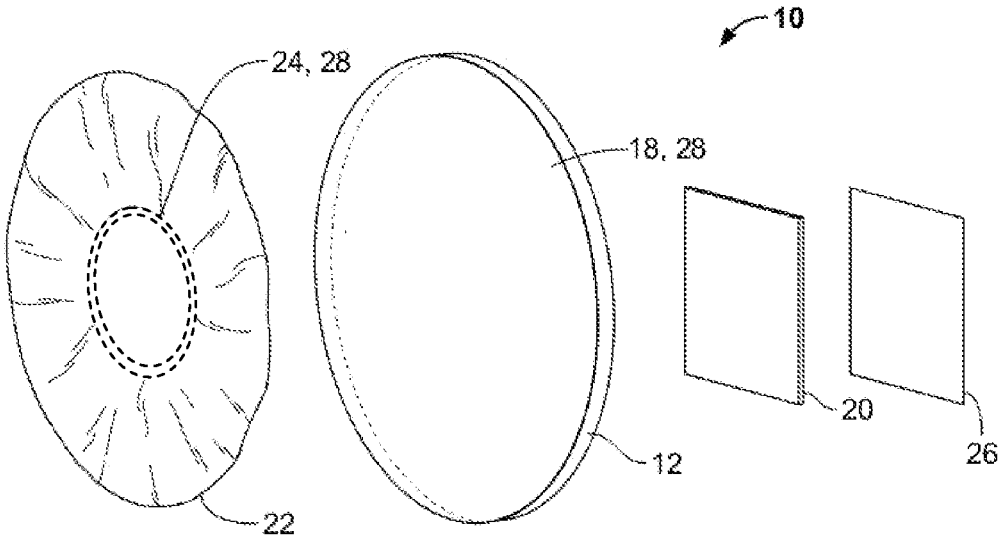
FIG. 3 shows an exploded perspective view of another embodiment of the present invention.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "affixing" as used herein refers to methods known to those skilled in the art for affixing one object to another. In this case, affixing the training device to an existing paper/cardboard target or other object for target shooting purposes. Such methods would include for example, double sided tape affixed to the back side of the target shooting training device marker or adhesive applied directly to the back side of the training device with a protective cover that can be removed to expose the adhesive for affixing to a paper target. Other similar means known to those skilled in the art such as Velcro™ may also be used. When Velcro™ is used, both the hook and loop portions of the Velcro™ will be provided on the back side of the target shooting training device marker. The complimentary half of the Velcro™ that is not affixed to the target shooting training device marker will be provided with adhesive on its back side so that it may be affixed to the existing projectile impact target.

The phrase "a distance away" or "a significant distance away" or "at a distance" as used herein refers to the distance between the individual discharging the weapon and the existing projectile impact target on which the target shooting training device marker(s) is/are affixed. This distance may vary and will depend on the size of the markers being used and the ability to see the marker at the desired distance. This distance can range from 15 to 150 feet for smaller sized markers and can be any specific distance within that range such as 25, 50, 75, 100 or 150 feet as well as greater distances for larger sized markers and includes distances of 50 to 200 yards or larger. One skilled in the art can determine an acceptable distance for observing the marker by setting the marker on an existing projectile impact target at the desired distance and have another individual artificially trigger the marker to assure that the user can observe the signal at that distance.

The phrase "flexible material" or "flexible cover" as used herein refers to a material that can be stretched over the semi-rigid support without easily distorting the support from its generally planar shape and having the ability, when penetrated, to return to its un-stretched form exposing the forward side of the semi-rigid support below. This is similar to what occurs when a balloon that is stretched over a surface is ruptured and the balloon material retracts to its original size exposing the surface beneath. There are a number of materials known to those skilled in the art that could be used for this purpose. One of these flexible materials having this quality is latex.

The term "indistinguishable" as used herein in reference to the forward side of the semi-rigid support as compared to the forward surface of the existing projectile impact target is subjective. It can mean that the user is unable to distinguish the semi-rigid support from the forward surface of the existing projectile impact target once hit by a projectile and the flexible cover has been completely torn away. It can also mean that it is observable that the target shooting training device marker was successfully hit because the user can distinguish a change in the marker after impact with a projectile because all or a portion of the flexible cover has been torn away from the semi-rigid support. It is also noted that when the forward side of the semi-rigid support and the forward surface of the existing projectile impact target are indistinguishable it may appear to the user that the marker has "disappeared".

The term "marking" in reference to the forward side of the semi-rigid support and the visible side of the flexible cover can be easily identified color, pattern or image. For example, a marker may have a flexible cover of a color that is easily visible at a distance from the user while the forward side of the semi-rigid support of that marker is identical or indistinguishable from the color, pattern or image on the existing projectile impact target on which the markers have been affixed. In this configuration, the marker appears to disappear when it is impacted by a projectile because the flexible cover ruptures and tears away exposing the forward side of the semi-rigid support. Alternatively, the flexible cover can be one easily observable color (e.g., fluorescent red) while the forward side of the semi-rigid support is the opposite of the flexible cover color (e.g. fluorescent green). In this configuration, the marker changes color (e.g., from red to green) when it is impacted by a projectile. In other examples, the flexible cover can have an image of a geometric shape of one color and the forward side of the semi-rigid support may have an image of a different geometric shape of the same color, the same shape but of a different color, the same geometric shape but larger or the same geometric shape but smaller. One skilled in the art could provide a variety of marking configuration that can provide the user with information about impacting the marker when viewed from a distance.

The term "marker" as used herein refers to a device that may be attached to an existing projectile impact target but is not itself a projectile impact target. An existing projectile impact target as used herein refers to a sheet of paper or cardboard with an image on its surface often indicating one or more bullseye(s), locations on the target the user attempts to hit while shooting. While these bullseyes are provided to help the user increase the accuracy of his/her shots, the aperture created by the penetration of the projectile may not be able to be observed beyond a particular distance. A marker of the present invention resolves this problem. One or more markers can be affixed at multiple locations on the existing projectile impact target easily visible by the user at a desired distance. A bullseye, meaning a hit on the marker, is immediately recognized, in one embodiment, when the color of the marker disappears or vanishes following impact by a projectile.

The term "replaceable" as used herein refers to the ability of a second flexible cover to be applied to an existing semi-rigid support affixed to an existing projectile impact target in which the first or original flexible cover has been hit by a projectile.

The term "semi-rigid" as it applies to the support for the marker refers to the ability of the support to remain planar or substantially planar once it is positioned within the flexible cover. While some bending may occur while inserting the semi-rigid support into the flexible cover, once positioned it can be manipulated into a retainable planar shape for use. It is not necessary that the marker be absolutely planar for use only that it remains substantially planar for mounting on an existing projectile impact target and visible to the user at the desired distance before target shooting commences.

The term "target shooting" or "shooting" as used herein refers to the discharging of a weapon wherein a projectile is directed at a target either for pleasure or for training purposes to increase accuracy. Shooting includes the use of weapons that discharge bullets utilizing gun powder or those that utilize compressed gas to discharge BBs or pellets as well as those that discharge arrows such as long bows, compound bows, crossbows and the like.

The present invention is a training device marker 10 for target shooting. The marker 10 comprising a semi-rigid support 12 having a forward side 14 and a back side 16, wherein the forward side 14 has a first marking 18 and wherein the back side 16 has an affixing means 20 for attaching the semi-rigid support 12 to a shooting target and a flexible material 22 stretched over the semi-rigid support 12 having a second marking 24 such that when the flexible material 22 is penetrated by a projectile 30 the flexible material 22 tears away from the semi-rigid support 12 exposing the first marking 18 wherein the complete or partial removal of the flexible material 22 can be identified at a distance away from the training device 10.

Support

The semi-rigid support 12 of the training device 10 comprises a forward side 14, or the side which is presented to or facing the shooter, a back side 16, which contains an affixing means 20 that allows the user to affix the training device 10 to a variety of targets that may be selected by the shooter. In one aspect of the present invention, the training device 10 is made of a semi-rigid material 12 that allows easy passage of a projectile 30 through both the forward 14 and back sides 16. In this configuration, the training device 10 may be made of a material, for example a light weight polymer or cardboard.

The support may be provided in a variety of shapes 28 such as a triangle, a square, a circle, an oval, a rectangle or any other shape desired. Preferably it is round or oval. If it is round, then it may have a diameter of from about 2.0 inches, 2.5 inches, 3.0 inches, 3.5 inches, 4.0 inches, 4.5 inches, 5.0 inches, 5.5 inches, 6.0 inches or 6.5 inches. If it is oval, then the largest dimension may be from about 2.0 inches, 2.5 inches, 3.0 inches, 3.5 inches, 4.0 inches, 4.5 inches, 5.0 inches, 5.5 inches, 6.0 inches or 6.5 inches.

To assist with the replacement of the flexible cover, each desired shape of the support is provided with projections along the perimeter edge to allow for ease of affixing a new flexible cover following rupture of the previous cover. A wide variety of configurations along the perimeter edge of the support may be used to assist with replacement of the flexible cover. In one embodiment, a circular support of about 5 inches in diameter has four projections, one at the top, one at the bottom and one on each side about equally spaced from each other along the perimeter edge. These can be half circular, have oval, rounded corner rectangular or rounded corner square knobs that project from the perimeter edge from about 1/64 ", about 1/32", about 1/16", about 3/32", about 1/8" about 3/16" or about 1/4 ". Alternatively the entire perimeter edge, or portions of the perimeter edge are scalloped with the scalloped projections of the size indicated above.

The support may be provided in a variety of thicknesses that provide sufficient rigidity when placed in the flexible cover. This will also depend on the material used for the support as well as the size of the support. For example, if the support is made of a rigid cardboard and the diameter of the support is 3.0 inches, the cardboard thickness can be about 1/128 inches, 1/64 inches, 1/32 inches or 1/16 inches. If the diameter of the support is 4.5 inches then thicknesses of 1/64 inches, 1/32 inches 1/16 inches, or 5/64 inches can be utilized. If the diameter of the support is 6.0 inches then thicknesses of 1/32 inches 1/16 inches, 5/64 inches, or 1/8 inches can be utilized. Correspondingly, if the support is made of rigid polymer the thickness for a 3.0 inch, 4.5 inch and 6.0 inch diameter support may have thickness of about one-fifth, about one-fourth, or about one-third of the thicknesses listed for supports made of rigid cardboard in these diameters.

In one embodiment, the flexible cover is replaceable after the marker is impacted by a projectile. In this configuration, one skilled in the art would recognize that the ability of the support to withstand an impact from a projectile without being substantially damaged would be important. Consequently, selection of a particular type of cardboard or polymer that is able to allow a projectile to pass though without substantially damaging the remainder of the support is preferred. These types of cardboards or polymers can be easily tested by routine experimentation to determine which have the desired qualities for use based on for example, size of the marker, size of the projectile and impact force.

These images provided on the forward side of the semi-rigid support will vary depending on the existing projectile impact target selected by the user. In one embodiment, the image can be different from those images produced on the flexible material 22 stretched over the semi-rigid support 12 or they may be the same image of differing color or they may be different images of differing color. The purpose for these distinguishing markings or images is to allow the user to identify when the target is hit without removing his/her eye from the weapon site and to adjust their aim and continue shooting. In a preferred embodiment, the image on the forward side of the semi-rigid support is similar to, indistinguishable from or the same as the image, pattern or color of the forward surface of the existing projectile impact target. The purpose for these markings is to allow the user to identify when the flexible cover is ruptured, tearing away from the semi-rigid support, essentially disappearing, without removing his/her eye from the weapon site and to adjust their aim and continue shooting.

Providing an easily discernable difference between the marker with the flexible cover and without the flexible cover eliminates the need for providing additional elements like that seen in U.S. patent application Ser. No. 13/359,768 to Su, wherein the device described is constructed of at least three layers instead of only two that effectuate the identifiable indicator. The target Interior portion that requires a perforation of a particular geometric shape, covered by a target pattern wadding layer with a bullseye layer on top. These layers are comprised of different materials meaning the requirement of multiple materials, prepared in different shapes meaning they must be punched or cut by machine, additional manufacturing steps are needed to create the perforations and substantial assembly is required to produce the final product. All of these increase the cost of manufacturing substantially over the marker of the present invention which comprises only two layers.

Providing markers for a larger firearm target allows the user to select from a large variety of different existing targets with a desired pattern or image for shooting practice. Further, the user can select specific locations within that pattern or image for projectile impact by placing one or more of the target shooting training device markers on the existing target at those desired locations. In addition, once those markers have been impacted, the flexible cover can be replaced and the existing target with the markers in position can be reused. If the user decides that different locations on the existing target are preferable over those previously selected, the user can place markers at those locations as well and continue shooting practice.

The use of unmodified flexible sheet material for the cover prevents the need for special manufacturing of uniquely designed materials like the elastic material utilized in the self-enlarging puncture firearm target of U.S. Pat. No. 3,370,852 to Kandel. The integral ribbing provided on one side of the elastic material as shown in FIG. 5, having circular interconnected ridges, allows for the projectile puncture to enlarge enabling the sharply contrasting color of the face surface of the base sheet to be easily visualized but not cause the flexible material to rupture and tear away from the firearm target. This is critical because without that specifically configured ribbing as shown in FIG. 5, the elastic material would rupture exposing the entire face surface of the base sheet making further projectile impacts difficult to observe without a visual aid. Thereby frustrating the purpose of the self-enlarging puncture fire arm target design.

Flexible Cover

The flexible cover 22 can be any material known to those skilled in the art that can be stretched over a semi-rigid support 12, does not substantially deform the semi-rigid support 12 and when torn or ruptured in its stretched form by a projectile 30, retracts or relaxes to its unstretched form exposing the semi-rigid support 12 below. In order for the flexible cover to rupture and retract as desired, in one embodiment, the material from which the flexible cover is prepared should have a consistent uniform thickness throughout and be smooth on both sides. Such a material could be for example rubber or latex. The flexible material 22 could be provided in a different color than the semi-rigid material 12 over which it is stretched so that when torn or ruptured exposes the different colored semi-rigid material 12 below. The flexible material 22 could have an image 24 on its surface that is not on the semi-rigid support 12 or that is different from the image 18 on the semi-rigid support 12 so that when ruptured the user sees that the image 24 on the target device marker 10 disappears or that the markings/images have changed color or design.

The resistance of the flexible cover to rupture by the impact of a projectile can be controlled/regulated/managed by the uniform thickness of the material used to create the cover as well as the extent to which the flexible cover is stretched over the semi-rigid support. For example, a thinner flexible material used to create the flexible cover, (e.g., 0.15 mm) will rupture and tear away from the semi-rigid support more quickly and completely than the same cover made of a thicker material (e.g., 1.0 mm). Correspondingly, a flexible cover that is stretched, increasing its surface area by 2.0 will rupture quicker and more completely than a flexible cover stretched increasing its surface area by 1.25. Therefore, one skilled in the art using routine experimentation can prepare the target shooting training device marker with a desired resistance to rupturing when impacted by a projectile. This may allow the user to select a target shooting training device marker that requires a more direct or bullseye impact to rupture completely, while glancing impacts do not.

In another embodiment, the flexible cover is replaceable. When a target shooting training device marker is hit by a projectile the flexible cover ruptures and tears away from the semi-rigid support. A replaceable flexible cover may be formed in a spherical shape with a circular opening, similar to a balloon, having a thickened rim about the opening that exerts force to retain its relaxed diameter when positioned over the semi-rigid support. The replaceable flexible cover is provided in a size that allows the semi-rigid support to be inserted and retain its relatively planar shape for use. For example, if the semi-rigid support is round, then the diameter of the spherical portion of the flexible cover is slightly less that the diameter of the semi-rigid support. For example, the ratio of the diameter of the flexible cover to the diameter of the semi-rigid support may be about 1:1.2, about 1:1.3, about 1:1.4, about 1:1.5, about 1:1.6, about 1:1.7, about 1:1.8, about 1:1.9, about 1:2.0, about 1:2.3, about 1:2.5, about 1:2.8, about 1:3.0, about 1:3.3, about 1:3.5 about 1:3.8, about 1:4.0, about 1:4.5 or about 1:5.0. The circular opening with the thickened rim is about one-sixth, about one-fifth, about one-fourth or about one-third the diameter of the spherical portion. The difference in the diameter between the semi-rigid support and the flexible cover is such that a sufficient force is created in the cover when placed over the semi-rigid support, that when impacted by a projectile it ruptures and completely tears away from the semi-rigid support.

The thickness of the rim on the circular opening of the flexible cover may be about 1.50 times the thickness of the material used for the flexible cover, about 1.60 times, about 1.70 times, about 1.80 times, about 1.90 times, about 2.00 time, about 2.10 times, about 2.20 times, about 2.30 times, about 2.40 times, about 2.50 times, about 2.60 times, about 2.75 times or about 3.00 times the thickness of the flexible cover material.

One skilled in the art can determine the appropriate size for the replaceable flexible cover given a specific sized semi-rigid support to assure that it ruptures and tears away as desired by simple routine testing. From this information a ratio can then be determined and may be applied to all other sizes of the semi-rigid supports. This can also be done with other desired semi-rigid support shapes.

Affixing Means

A variety of means may be utilized to affix the target shooting training device marker to an existing projectile impact target. In one embodiment an adhesive is applied directly to the back side of the semi-rigid support. Alternatively a double sided adhesive tape may be applied to the backside of the semi-rigid support. In each case, a protective covering may be provided over the adhesive to protect it from damage prior to use.

In another embodiment, a two part Velcro™ strip comprised of a hook portion and a loop portion of about the same size. Each of these portions having an adhesive directly applied or provided as a double sided tape on the back side of each portion, for affixing to the back side of the semi-rigid support and to the existing projectile impact target. For example, the back side of the hook portion of the two part Velcro™ strip may be affixed by adhesive to the back side of the semi-rigid support and the loop portion of the two part Velcro™ strip may be affixed by adhesive to the existing projectile impact target or visa versa. The benefit for this configuration is that it allows the user to remove the marker from the existing projectile impact target to replace the flexible cover and reattach the marker to target. It is also possible to merely place a new, replacement cover, over the semi-rigid support while in place when the marker is affixed to the existing projectile impact target by adhesive or adhesive tape alone. Other methods known to those in the art may also be utilized, for example when the existing projectile impact target is made of a magnetically susceptible a strip of magnetic polymer can be used to affix the marker to the existing target. If the existing projectile impact target is wood, the marker can be carefully stapled to the target through the flexible cover and semi-rigid support without causing the cover to rupture.

While a variety of configurations may be utilized for placement of one or more Velctor™ pieces or strips, one skilled in the art can, with routine experimentation, determine the best configuration for the specific type, size or speed of the particular projectile desired for target shooting. In one example, there are four circular patches of the Velcro™ loop portions spaced equally apart and attached to the back side of the support. The loop portions are about ½, about ⅓, about ¼, about ⅕ or about ⅙ the size of the hook portion of the Velcro™ that is affixed to the existing projectile impact target.

Use

In use the shooter removes one or more training device markers from their packaging. The existing projectile impact target used for training is prepared to accept the training device markers of the present invention. The protective coatings are removed from the adhesive strips on the back side of each marker and the markers are positioned as desired on the existing target. The target containing the training device markers is then placed at a desired distance from the shooter. When in position the shooter can commence shooting at the markers positioned on the existing projectile impact target. When a marker is impacted by a projectile, the flexible cover ruptures and tears away from the semi-rigid support exposing part or all of its forward side. Since the pattern and or color of the markings on the semi-rigid support and the flexible cover are different, the shooter is able to immediately identify if the marker was hit without removing aim from the line of sight, adjust that aim if necessary and continue shooting.

In one embodiment, the target shooting training device marker is round or oval and of a size that is easily recognizable at the distance from which the user is positioned for shooting. The protective cover is removed from the adhesive directly deposited on the back of the semi-rigid support, on double sided tape or on the Velcro™ strip. Desired locations on the existing projectile impact target are identified by the user and the markers applied at these locations. The modified existing projectile impact target is then positioned a t the desired distance from the user. The user may confirm that the markers are visible at the distance selected before initiating training. The flexible cover of the markers are provided in bright easily recognizable colors, patterns or image, while the semi-rigid support is of a color or contains a pattern/image that is less easily or not recognizable at the desired distance once the flexible cover is ruptured. More specifically, when one of the markers on the existing projectile impact target is impacted, the brightly colored flexible cover ruptures and tears away from the semi-rigid support that is essentially indistinguishable from the color/pattern or image of the existing projectile impact target. In essence, once hit the marker appears to disappear from view providing the user with important information regarding his/her aim.

Consequently, the training device markers of the present invention provide the shooter with immediate information as to the shot recently taken allowing them to maintain their aim, applying the information obtained from their last shot and adjusting the their aim prior to taking the next shot. This can all be done without the visual assistance of binoculars or a spotter and allows the user to maintain his/her line of sight, readjust his/her aim and fire another round without relaxing their weapon, or removing their weapon from their aim on the existing projectile impact target.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

I claim:

1. A target shooting training device marker to be affixed to an existing projectile impact target comprising:

a semi-rigid support having a forward side and a back side, wherein said forward side is of a color or pattern that is indistinguishable from said existing projectile impact target to which it is affixed and wherein said back side has an adhesive or adhesive tape affixed thereon for attaching one or more said target shooting training device markers to an existing projectile impact target, said adhesive or adhesive tape having a protective coating and a replaceable flexible cover of a thickness able to be stretched over said semi-rigid support and of a color that is easily observed by the user at a distance from said existing projectile impact target containing one or more target shooting training device markers such that when said flexible material cover is penetrated by a projectile said flexible material cover tears away from said semi-rigid support exposing said forward side of said target shooting training device marker having the same color or pattern of said existing projectile impact target causing said target shooting training device marker to disappear when viewed at a distance away from said existing projectile impact training said replaceable flexible cover being spherical in shape with a circular opening having a rim, said rim having a thickness greater than said thickness of said replaceable flexible cover.

2. The target shooting training device marker according to claim 1, wherein said semi-rigid support is made of a soft material that allows passage of a high speed projectile without deformation of said semi-rigid support.

3. The target shooting training device marker according to claim 2, wherein said soft material is a polymer, a cardboard, a high basis-weight paper.

4. The target shooting training device marker according to claim 1, wherein said flexible material is latex.

5. A method of training an individual to shoot a weapon comprising the steps of:

affixing one or more target shooting training device markers to an existing projectile impact target, said one or more target shooting training device markers comprising:

a semi-rigid support having a forward side and a back side, wherein said forward side is of a color or pattern that is indistinguishable from said existing projectile impact target to which it is affixed and wherein said back side has an adhesive or adhesive tape affixed thereon for attaching one or more said target shooting training device markers on an existing projectile impact target, said adhesive or adhesive tape having a protective coating and a flexible material cover stretched over said semi-rigid support of a color that is easily observed by the user at a distance from said existing projectile impact target containing one or more target shooting training device markers such that when said flexible material cover is penetrated by a projectile said flexible material cover tears away from said semi-rigid support exposing said forward side of said target shooting training device marker having the same color or pattern of the existing projectile impact target causing said target shooting training device marker to disappear when viewed at a distance away from said existing projectile impact training target; and having said individual shoot at said target shooting training device markers on said existing projectile impact target wherein exposing said first forward side on said semi-rigid support when said target shooting training device markers are hit by a projectile, provides feedback to said individual without said individual having to cease firing while confirming a hit on said existing projectile impact target with visual assistance before continuing to shoot said weapon.

6. The target shooting training device marker according to claim 1, wherein said target shooting training device marker is round or oval.

7. The target shooting training device marker according to claim 6 wherein said target shooting training device marker is round and having a diameter of about 2.0 inches, about 2.5 inches, about 3.0 inches, about 3.5 inches, about 4.0 inches, about 4.5 inches, about 5.0 inches, about 5.5 inches, about 6.0 inches or about 6.5 inches.

8. The target shooting training device marker according to claim 6 wherein said target shooting training device marker is oval and wherein the largest dimension is about 2.0 inches, about 2.5 inches, about 3.0 inches, about 3.5 inches, about 4.0 inches, about 4.5 inches, about 5.0 inches, about 5.5 inches, about 6.0 inches or about 6.5 inches.

* * * * *